US010186800B2

(12) United States Patent
Matsuura

(10) Patent No.: US 10,186,800 B2
(45) Date of Patent: Jan. 22, 2019

(54) WIRING COVER, AND CONNECTOR HAVING WIRING COVER

(71) Applicant: Sumitomo Wiring Systems, Ltd., Yokkaichi, Mie (JP)

(72) Inventor: Masahito Matsuura, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/741,838

(22) PCT Filed: Jun. 17, 2016

(86) PCT No.: PCT/JP2016/068066

§ 371 (c)(1),
(2) Date: Jan. 4, 2018

(87) PCT Pub. No.: WO2017/006747

PCT Pub. Date: Jan. 12, 2017

(65) Prior Publication Data

US 2018/0198231 A1 Jul. 12, 2018

(30) Foreign Application Priority Data

Jul. 8, 2015 (JP) ..... 2015-136857

(51) Int. Cl.
*H01R 13/58* (2006.01)
*H01R 13/502* (2006.01)
*H01R 13/629* (2006.01)

(52) U.S. Cl.
CPC ..... *H01R 13/5833* (2013.01); *H01R 13/502* (2013.01); *H01R 13/58* (2013.01);
(Continued)

(58) Field of Classification Search
CPC ..... H01R 13/5833; H01R 13/5841; H01R 13/5812; H01R 13/502; H01R 13/62938
(Continued)

(56) References Cited

U.S. PATENT DOCUMENTS 3,622,942 A * 11/1971 Rynk ..... H01R 13/5804 439/471
4,564,255 A * 1/1986 Kirma ..... H01R 13/5804 439/471
(Continued)

FOREIGN PATENT DOCUMENTS

EP 0865131 A1 9/1998
JP 2010062077 A 3/2010
(Continued)

OTHER PUBLICATIONS

International Search Report dated Sep. 13, 2016.
European Search Report dated May 30, 2018.

*Primary Examiner* — Harshad C Patel
(74) *Attorney, Agent, or Firm* — Gerald E. Hespos; Michael J. Porco; Matthew T. Hespos

(57) ABSTRACT

A wire cover (30) to be mounted on a rear surface of a connector body (C) that is connected to ends of wires (W). The wire cover (30) is configured to hold the wires (W) while bending the wires (W) in a predetermined direction. The wire cover (30) includes a wire fixing portion (38) provided on a rear part to project in the predetermined direction and a protruding portion (41) provided to protrude from the wire fixing portion (38) in a direction substantially perpendicular to a connecting direction of the connector body (C) and a mating connector (50).

8 Claims, 10 Drawing Sheets

(52) U.S. Cl.
CPC ... *H01R 13/5812* (2013.01); *H01R 13/62933* (2013.01); *H01R 13/62938* (2013.01)

(58) Field of Classification Search
USPC ..... 439/157
See application file for complete search history.

(56) References Cited

U.S. PATENT DOCUMENTS

| | | | | |
|---|---|---|---|---|
| 6,056,587 | A * | 5/2000 | Matsuoka | H01R 13/5804 439/464 |
| 7,931,483 | B2 * | 4/2011 | Komiyama | H01R 13/62977 439/157 |
| 2002/0173186 | A1 * | 11/2002 | Tsuchiya | H01R 13/62938 439/157 |
| 2003/0199185 | A1 * | 10/2003 | Fujii | H01R 13/506 439/157 |
| 2006/0240693 | A1 * | 10/2006 | Nishide | H01R 13/62938 439/157 |
| 2015/0056842 | A1 | 2/2015 | Kataoka et al. | |
| 2016/0204538 | A1 | 7/2016 | Matsuura | |
| 2016/0261069 | A1 | 9/2016 | Noro | |

FOREIGN PATENT DOCUMENTS

| | | |
|---|---|---|
| JP | 2013-251115 | 12/2013 |
| WO | 2015064322 A1 | 5/2015 |

* cited by examiner

WIRING COVER, AND CONNECTOR HAVING WIRING COVER

BACKGROUND

Field of the Invention

The invention relates to a wire cover and a connector with wire cover.

Description of the Related Art

A known connector has a connector body and a wire cover mounted to a rear end of the connector body for holding wires while bending the wires in a predetermined direction. For example, Japanese Unexamined Patent Publication No. 2013-152885 discloses a connector a wire cover that is open laterally and wires are bent by the wire cover to be pulled out in a lateral direction. The wires are disposed along a wire fixing portion provided at an opening of the wire cover and are bound by a tie band to be fixed to the wire fixing portion.

The rear surface of the wire cover is pressed when the above-described connector is connected to a mating connector. However, the rear surface of the wire cover is curved along the peripheral surface of a wire bundle and is difficult to press. Thus, a connecting operation to the mating connector has not been easy.

The present invention was completed based on the above situation and aims to provide a wire cover and a connector with wire cover enabling a connecting operation to a mating connector to be performed easily.

SUMMARY

A wire cover of the present invention is to be mounted on a rear surface of a connector body connected to an end of a wire and configured to hold the wire while bending the wire in a predetermined direction. The wire cover includes a wire fixing portion provided on a rear part to project in the predetermined direction, and a protruding portion that protrudes from the wire fixing portion in a direction substantially perpendicular to a connecting direction of the connector body and a mating connector.

A connector with a wire cover in accordance with the invention includes a connector body to be connected to an end of a wire, and the above-described wire cover.

According to the invention, the rear surface of the protruding portion can be pressed during a connecting operation to the mating connector. Thus, the connecting operation to the mating connector can be performed easily.

A band may be wound on a side of the wire fixing portion in front of the protruding portion to fix the wire. According to this configuration, the band can be positioned by the protruding portion.

A recess may be formed in a protruding end part of the protruding portion. According to this configuration, the position of a head part of the band can be determined by fitting the head part into the recess formed in the protruding portion.

The connector body may include a housing connectable to a mating connector and a lever enabling the mating connector and the housing to be connected properly by being rotated from an initial position to a connection position An entrance of a cam groove engages with a cam pin on the mating connector when the lever is disposed at the initial position. The entrance to the cam groove and the protruding portion may be at positions corresponding in a width direction of the housing. According to this configuration, the connector body is pressed in a facing direction of the entrance of the cam groove of the lever and the cam pin of the mating connector by pressing the rear surface of the protruding portion during the connecting operation to the mating connector. Thus, the connecting operation to the mating connector can be performed easily.

DETAILED DESCRIPTION

Hereinafter, one specific embodiment of the present is described in detail with reference to FIGS. 1 to 10.

Figure 1:
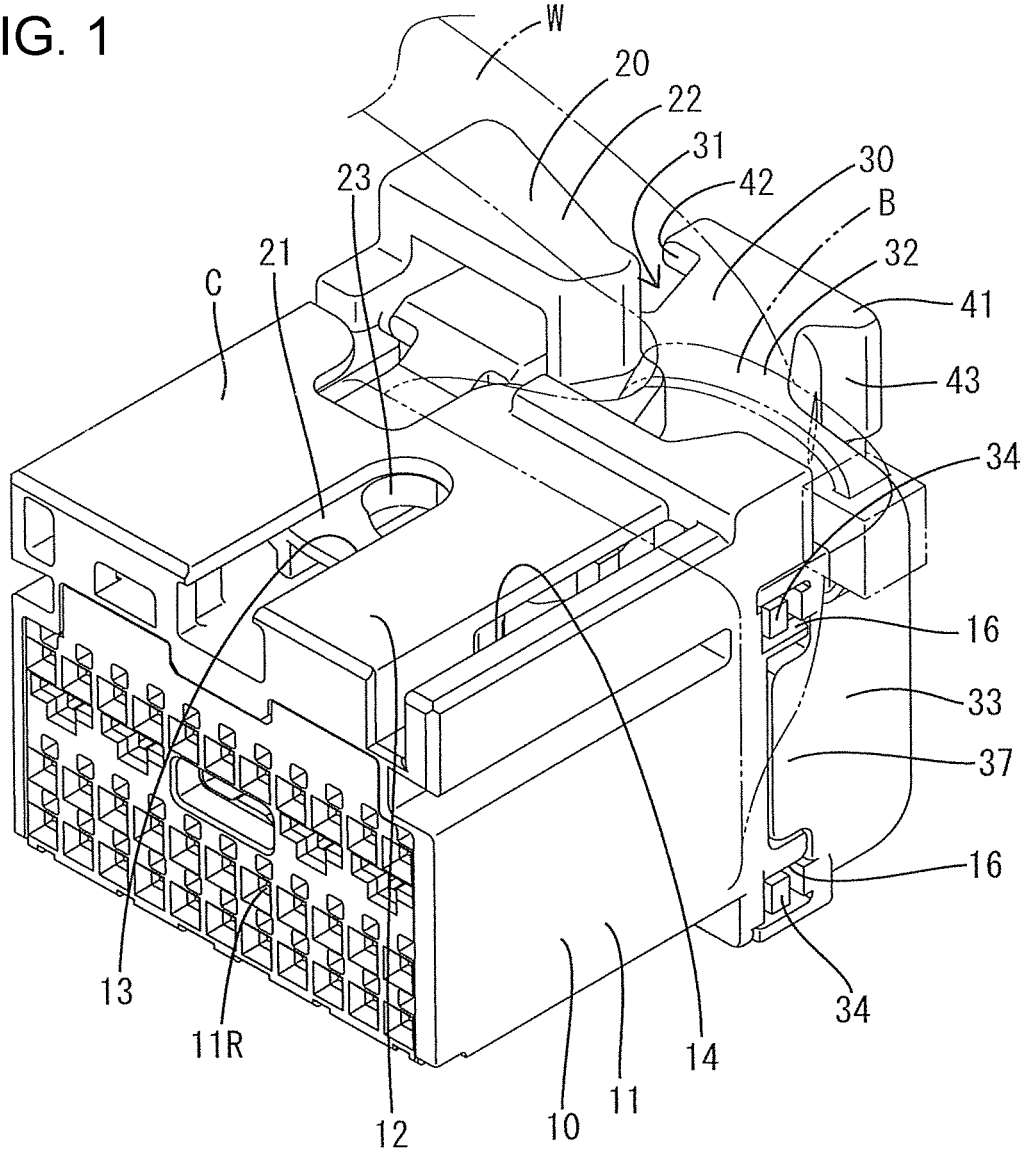
FIG. 1 is a perspective view showing a connector in an embodiment.

A connector with wire cover in this embodiment includes a connector body C to be connected to ends of wires W, and a wire cover 30 for holding the wires W while bending the wires W in a predetermined direction. The connector body C includes a housing 10 into which terminal fittings (not shown) connected to end parts of the wires W are accommodated, and a lever 20 that is rotated to connect and separate the connector to and from a mating connector 50. In the following description, in each constituent member, connection surfaces of the connectors are referred to as the front, and upper and lower sides in FIG. 1 are referred to as upper and lower sides.

Figure 2:
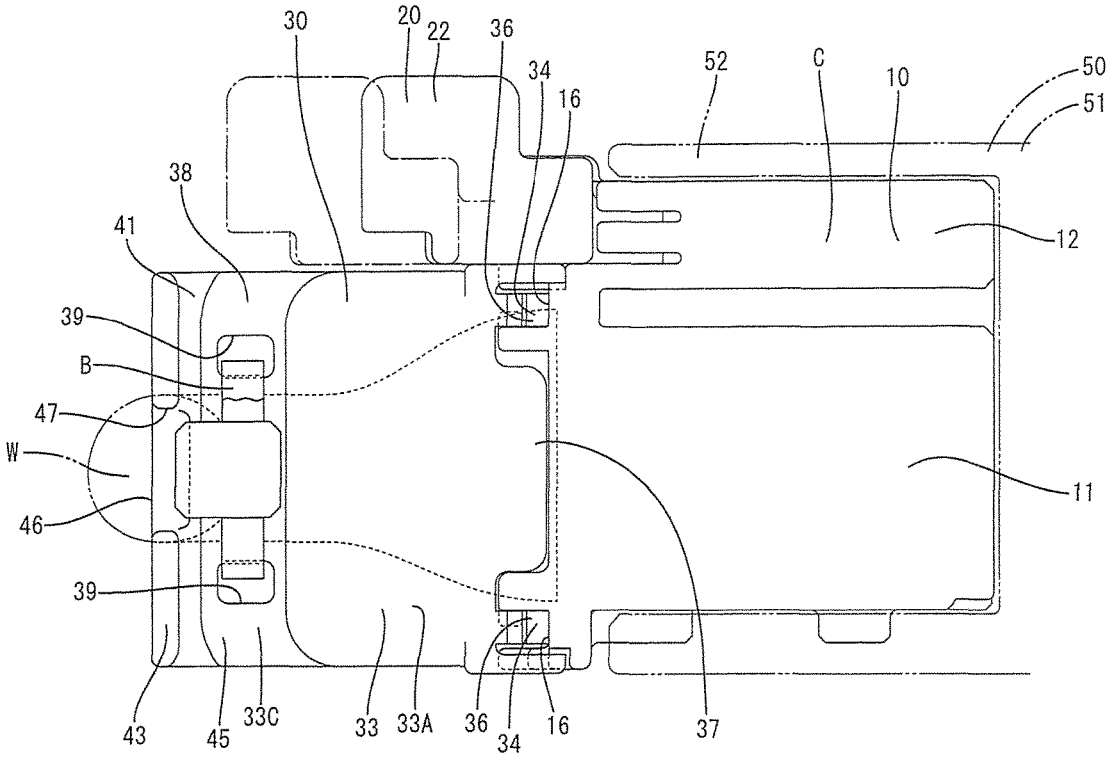
FIG. 2 is a side view of the connector showing a state of connecting the connector to a mating connector.

A housing 51 of the mating connector 50 is made of synthetic resin and includes, as shown in FIG. 2, a forwardly open receptacle 52. A cylindrical cam pin 53 projects down (into an inner space of the receptacle 52) on an upper wall of the receptacle 52. As show in FIG. 4, the cam pin 53 is in a widthwise central part of the receptacle 52 and located closer to a front end than a center in a front-rear direction of the receptacle 52.

The housing 10 is made of synthetic resin and defines a substantially rectangular block that can fit into the receptacle 52 of the mating connector 50. The housing includes a terminal accommodating portion 11 into which terminal fittings are accommodated and a lever accommodating portion 12 into which the lever 20 is accommodated.

Terminal accommodation chambers 11R are provided in the terminal accommodating portion 11 for individually accommodating the terminal fittings. The terminal accommodation chambers 11R are separated in stages in a vertical direction and are arranged side by side in a lateral direction in each stage. The terminal fittings are accommodated into the terminal accommodation chambers 11R from behind, and the wires W are pulled out rearward from the rear surface of the housing 10.

Figure 4:
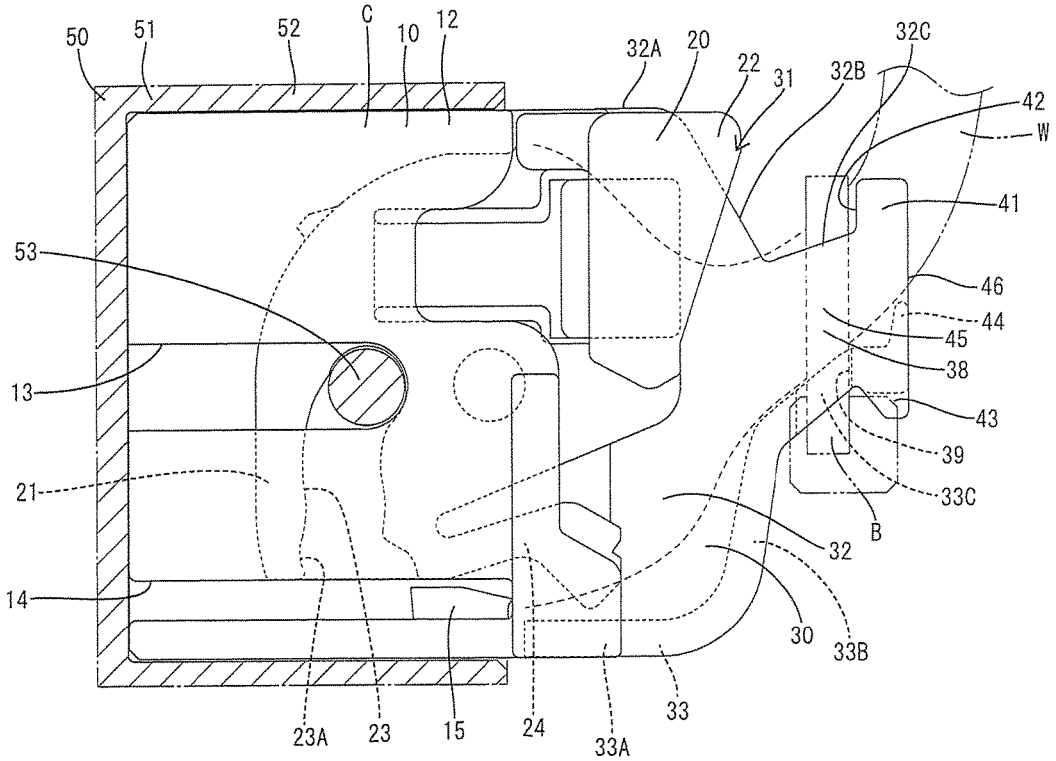
FIG. 4 is a section showing the connector in a state properly connected to the mating connector.
Figure 5:
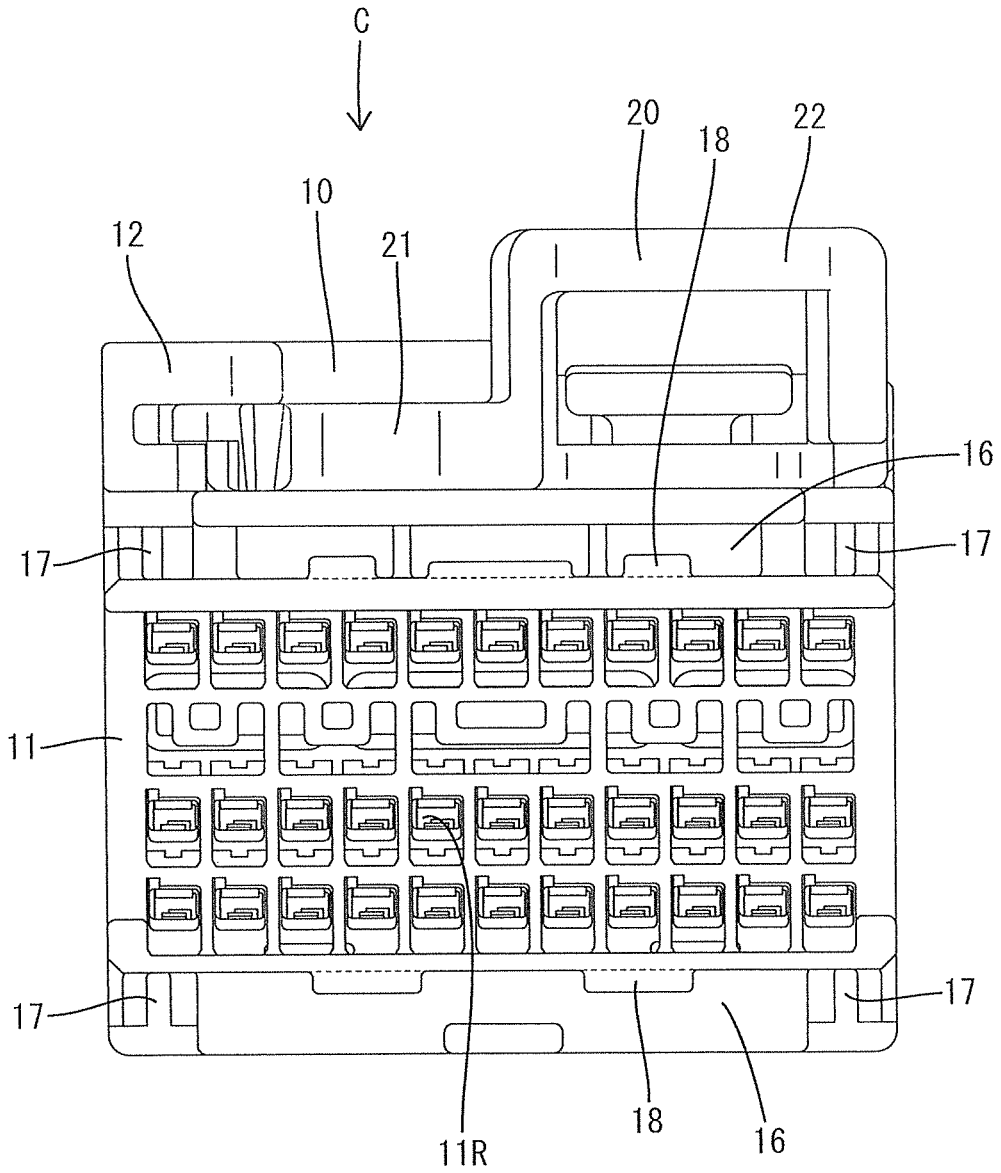
FIG. 5 is a back view showing a connector body.

The lever accommodating portion 12 is dimensioned to extend substantially over the entire upper surface of the housing 10 in a width direction and a rear end part slightly projects rearward from the rear surface of the housing 10. As shown in FIG. 4, the lever accommodating portion 12 is provided with a first receiving path 13 for receiving the cam pin 53 of the mating connector 50 and a second receiving path 14 for receiving an unillustrated unlocking portion. The first and second receiving paths 13, 14 extend straight rearward from the front end of the lever accommodating portion 12. The first receiving path 13 is located in a substantially widthwise center of the housing 10 and the second receiving path 14 is located on one widthwise end side of the housing 10.

Further, the lever accommodating portion 12 is provided with an initial lock 15 lockable to an initial lock piece 24 on the lever 20. The initial lock 15 projects at a position near the rear end of the second receiving path 14.

Cover mounting portions 16 are provided on the rear surface of the housing 10, and the wire cover 30 is mounted on the cover mounting portions 16 by being slid in the lateral direction. The cover mounting portions 16 are provided on both upper and lower sides of the housing 10 and are spaces open on rear, left and right sides. Note that the lower cover mounting portion 16 is projects slightly down from the lower surface of the housing 10 (see FIG. 9).

Figure 10:
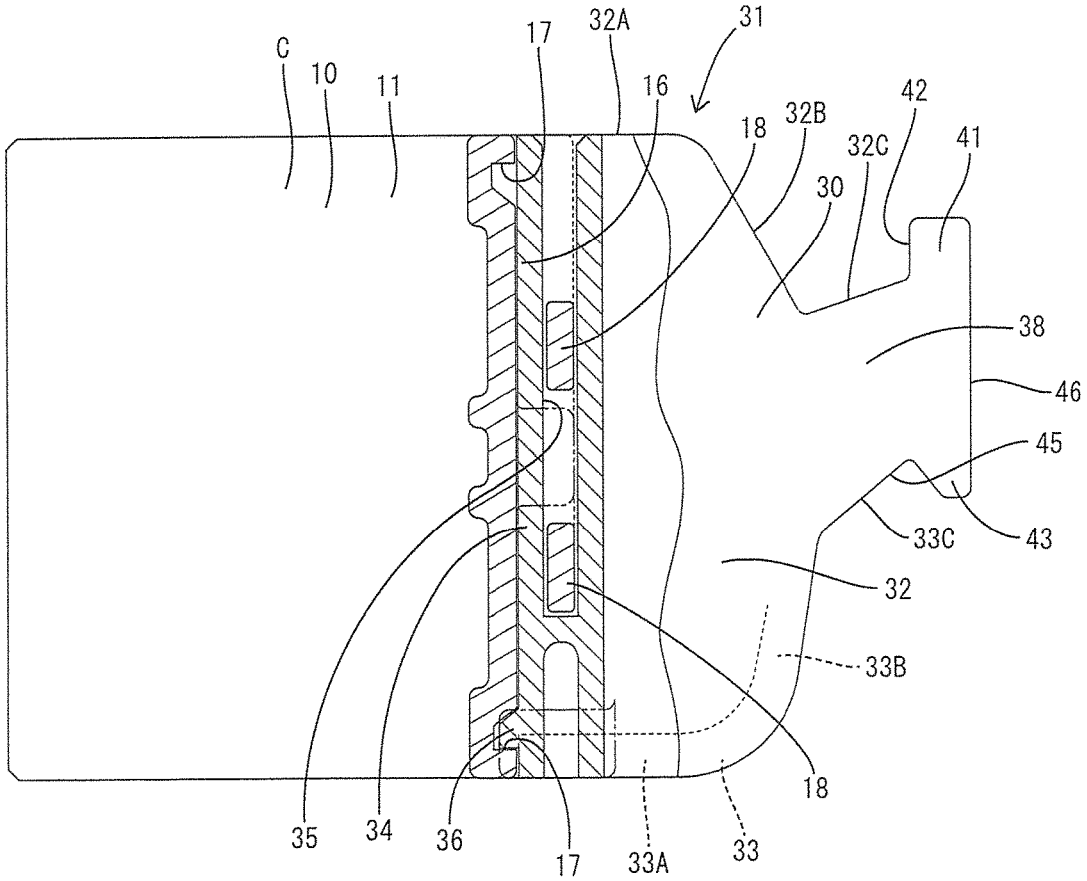
FIG. 10 is a section showing a state where the wire cover is mounted on the connector body.

The upper and lower cover mounting portions 16 extend over the entire width of the housing 10, and locking portions 17 to which locking pieces 36 provided on the wire cover 30 are lockable are provided on both left and right end parts of each cover mounting portion 16, as shown in FIG. 10. Further, each cover mounting portion 16 is provided with guiding ribs 18 for guiding a sliding movement of the wire cover 30. The guiding ribs 18 stand at plural of positions along the rear end edge of each cover mounting portion 16.

The lever 20 is a rotary lever made of synthetic resin and includes, as shown in FIG. 4, a flat cam plate 21 made of synthetic resin and an operating portion 22 to be operated by fingers placed thereon when rotating the lever 20. The cam plate 21 of the lever 20 is assembled with the lever accommodating portion 12 with a tiny clearance formed therebetween, and the operating portion 22 projects rearward from the lever accommodating portion 12. The lever 20 is disposed at an initial position before connection to the mating connector 50 and enables the connectors to be connected properly by being rotated to a connection position.

A cam groove 23 is formed in the upper surface of the cam plate 21 and engages the cam pin 53 of the mating connector 50. The cam groove 23 is a recess extending from an end edge of the cam plate 21 toward a center. When the lever 20 is at the initial position, an entrance 23A of the cam groove 23 is at the first receiving path 13 (widthwise central part of the housing 10) and the cam pin 53 can be received into the cam groove 23.

The cam plate 21 is provided with the initial lock piece 24 for holding the lever 20 at the initial position by being locked to the initial lock 15 of the lever accommodating portion 12 when the lever 20 is at the initial position. The initial lock piece 24 is cantilevered from the vicinity of the entrance 23A of the cam groove 23, and a tip part of the initial lock piece 24 is locked to the initial lock 15.

The wire cover 30 is mounted on the rear surface of the connector body C, has a U-shaped cross-sectional shape open on a front surface side and is open only on one lateral side. The wires W pulled out from the housing 10 are bent in the wire cover 30 and are pulled out from the open side at a wire pull-out opening 31.

The wire cover 30 can be mounted on the housing 10 with an orientation changed in the lateral direction. Specifically, the wire cover 30 can be mounted on the connector body C in either one of a first orientation (see FIG. 1) in which the wire pull-out opening 31 is facing right and a second orientation (see FIG. 3) in which the wire pull-out opening 31 is facing left.

Figure 6:
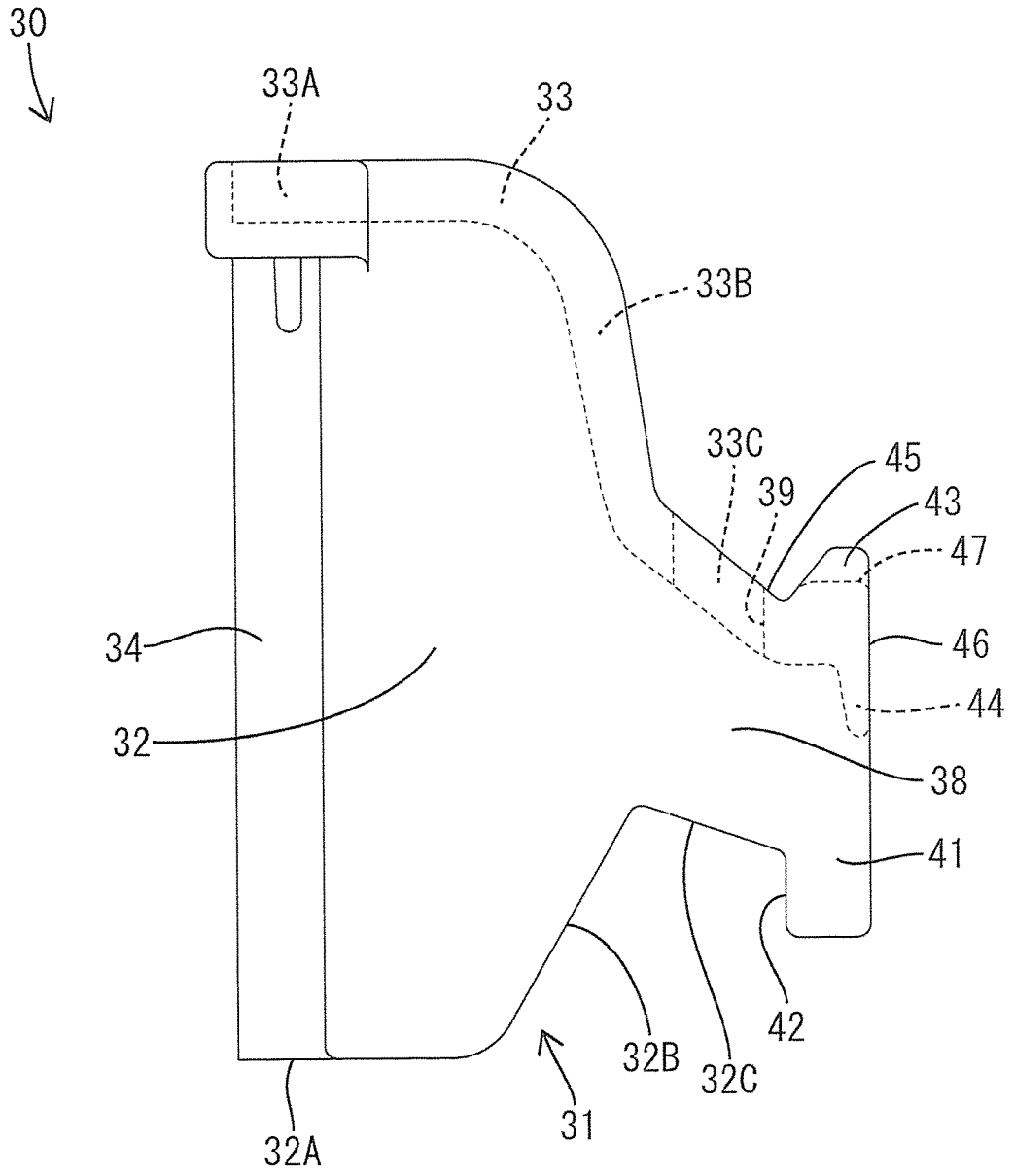
FIG. 6 is a plan view showing a wire cover.
Figure 7:
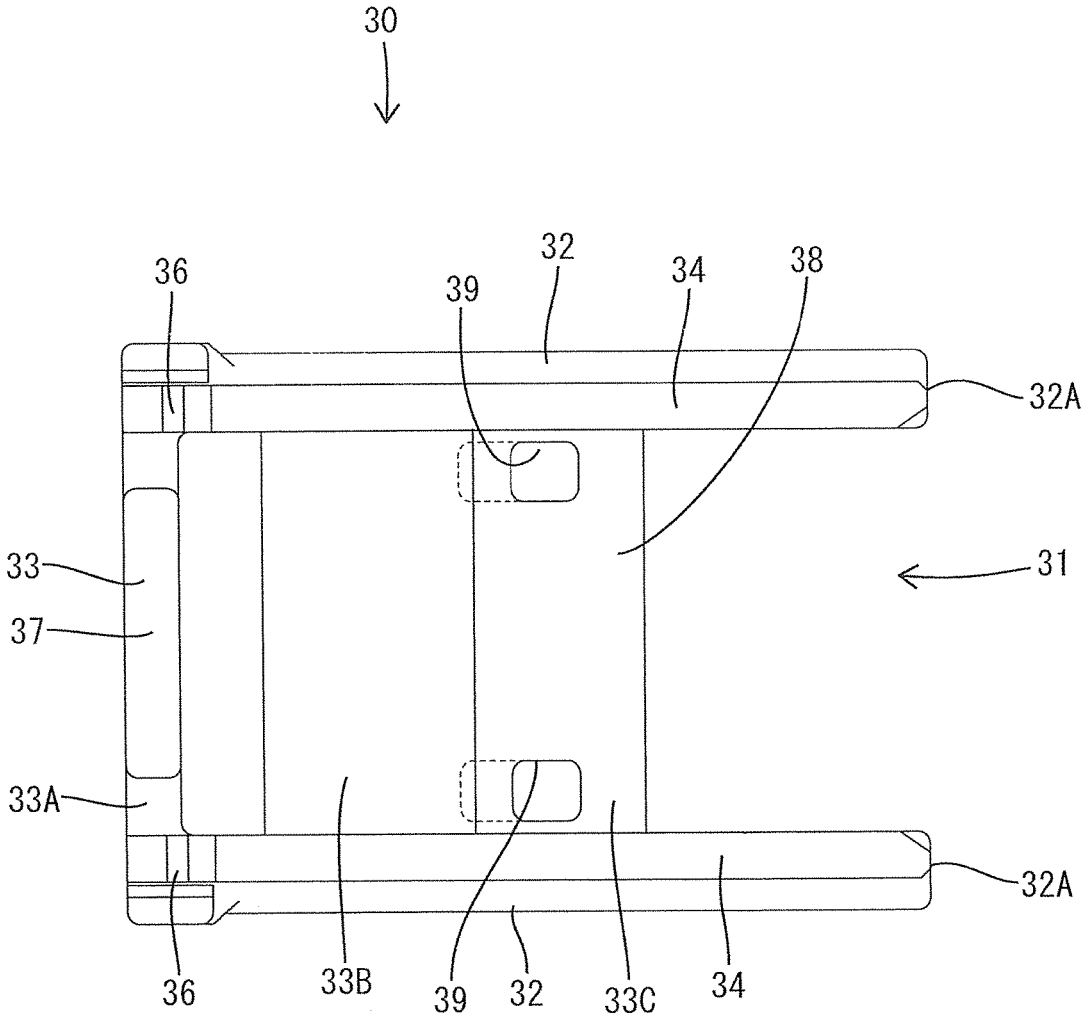
FIG. 7 is a front view showing the wire cover.

As shown in FIG. 6, the wire cover 30 includes upper and lower walls 32 and a second wall 33 on a side opposite to the wire pull-out opening 31 in the lateral direction. The upper and lower first walls 32 have substantially the same shape and same thickness and are substantially parallel to each other. The second wall 33 is provided along end surfaces of the upper and lower first walls 32.

A front end 33A of the second wall 33 is substantially at a right angle to the rear surface of the housing 10 in a state mounted on the connector body C. An outer surface of the front end part 33A of the second wall 33 is connected to the right or left side surface of the housing 10 without a step.

Figure 8:
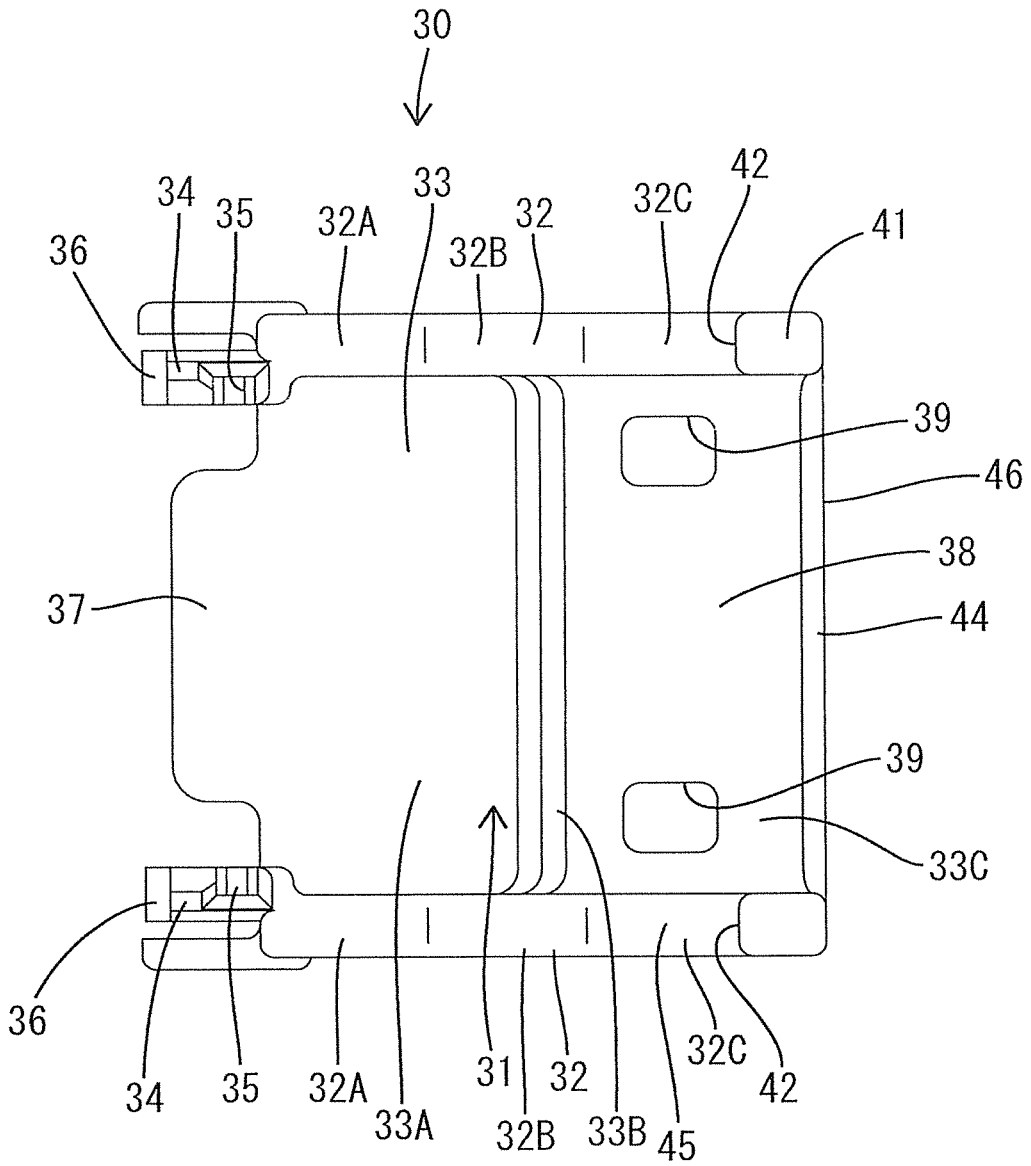
FIG. 8 is a side view showing the wire cover.

Further, as shown in FIG. 8, the front end part 33A of the second wall 33 is provided with a projecting wall 37 projecting between upper and lower slide portions 34. The projecting wall 37 fills up a space between the upper and lower cover mounting portions 16 in the housing 10 with the wire cover 30 mounted on the connector body C.

An intermediate portion 33B connected to the rear end of the front end part of the second wall 33 is substantially at a right angle to a front-rear direction as shown in FIG. 6. The intermediate portion 33B of the second wall 33 faces the rear surface of the connector body C when the wire cover 30 is mounted on the connector body C.

A front end part 32A of the end surface of the first wall 32 is substantially parallel to the front end part 33A of the second wall 33. The front end part 32A of the first wall 32 is connected to the right or left side surface of the housing 10 without a step. Further, a intermediate part 32B of the end surface of the first wall 32 connected to the rear end of the front end part 32A extends obliquely rearward toward a widthwise center.

A front end part of the wire cover 30 is formed with the slides 34 having a width extending over the entire width of the housing 10 and slidable in the lateral direction along the cover mounting portions 16 of the housing 10. The slides 34 are provided on both upper and lower sides of the wire cover 30 and respectively extend in the lateral direction along the front edges of the first walls 32.

As shown in FIG. 10, each slide 34 is formed with a slide groove 35 open on one side (side of the wire pull-out opening 31) and closed on the other side in the lateral direction. The guiding ribs 18 of the housing 10 are inserted into the slide groove 35.

Each slide 34 is provided with the locking piece 36 lockable to the locking portion 17 of the housing 10. The locking piece 36 is provided on an end part of the slide 34 on the side of the second wall 33 (rear end part in a sliding direction at the time of mounting). The locking piece 36 is cantilevered rearward (down in FIG. 10) in the sliding direction at the time of mounting.

To mount the wire cover 30 on the connector body C, the slides 34 of the wire cover 30 are inserted into the cover mounting portions 16 with the wire pull-out opening 31 in the lead and the guiding ribs 18 of the housing 10 are inserted and slid into the slide grooves 35 of the wire cover 30. Then, as shown in FIG. 10, the guiding ribs 18 reach the closed end parts of the slide grooves 35 to restrict any further sliding movement and the locking pieces 36 are locked to the locking portions 17 to restrict a sliding movement in an opposite direction. In this way, the wire cover 30 is mounted on the connector body C.

The wire cover 30 is provided with a wire fixing portion 38 to which the wires W are fixed. The wire fixing portion 38 projects obliquely rearward in a rear part of the wire cover 30.

A rear end part 33C of the second wall 33 constituting the wire fixing portion 38 is inclined obliquely rearwardly from one end of the intermediate portion 33B of the second wall 33.

Figure 9:
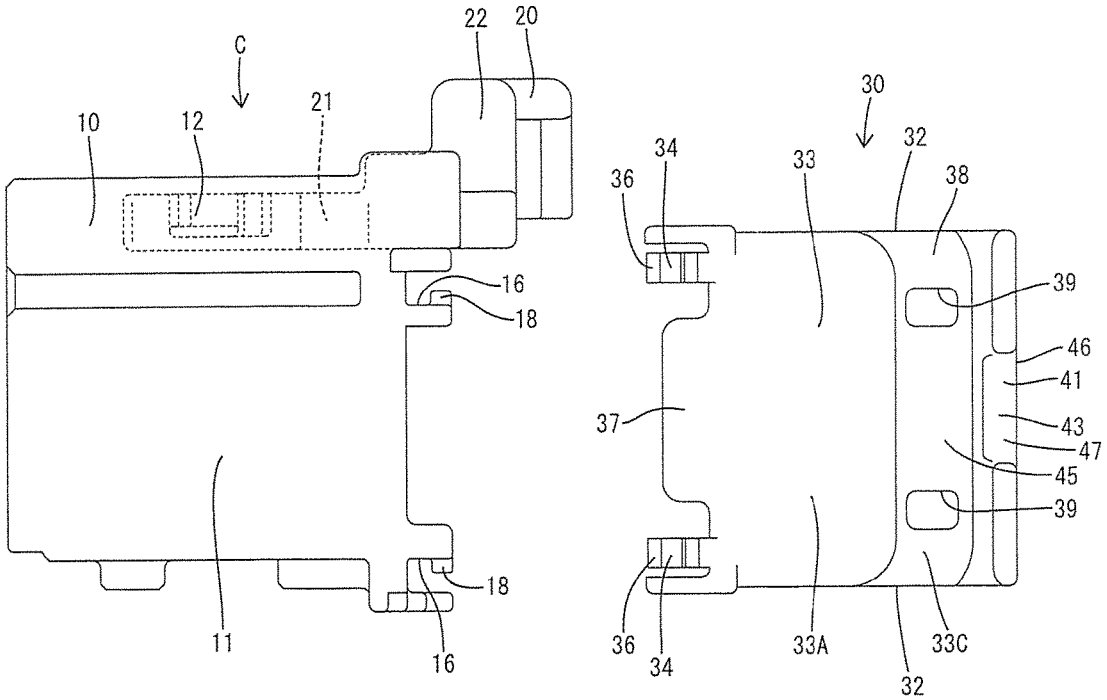
FIG. 9 is a side view showing a state before the wire cover is mounted on the connector body.

As shown in FIG. 9, the rear end part 33C of the second wall 33 is provided with upper and lower band through holes 39 enabling the passage of a tie band B. The upper and lower band through holes 39 are provided respectively at positions near the upper and lower first wall portions 32. Each band through hole 39 has a rectangular shape long in a horizontal direction.

Further, a rear end part 32C of the first wall 32 constituting the wire fixing portion 38 is connected substantially at a right angle to the rear end of the intermediate portion 32B of the first wall 32, as shown in FIG. 6. The rear end part 32C of the first wall 32 is inclined with a different gradient in the same direction as the rear end part 33C of the second wall 33. The wire fixing portion 38 has a smaller width (lateral dimension) on a rear end side than on a front end side.

The wire cover 30 is provided with a protruding portion 41 protruding from the wire fixing portion 38 in the lateral direction (direction substantially perpendicular to a connecting direction of the connector body C and the mating connector 50). The protruding portion 41 is provided on a rear end part of the wire fixing portion 38 and protrudes toward both left and right sides from the wire fixing portion 38.

As shown in FIG. 4, the protruding portion 41 is at a position slightly displaced toward the open side of the wire cover 30 in a widthwise central part of the wire cover 30. This protruding portion 41 is at substantially the same position in the width direction of the housing 10 as the entrance 23A of the cam groove 23 when the lever 20 is at the initial position.

A first protruding wall 42 of the protruding portion 41 connected to the rear end part 32C of the first wall 32 projects laterally at an obtuse angle to the rear end part 32C of the first wall 32, as shown in FIG. 6.

Further, a second protruding wall 43 of the protruding portion 41 connected to the rear end part 33C of the second wall 33 is substantially at a right angle to the rear end part 33C of the second wall 33.

Figure 3:
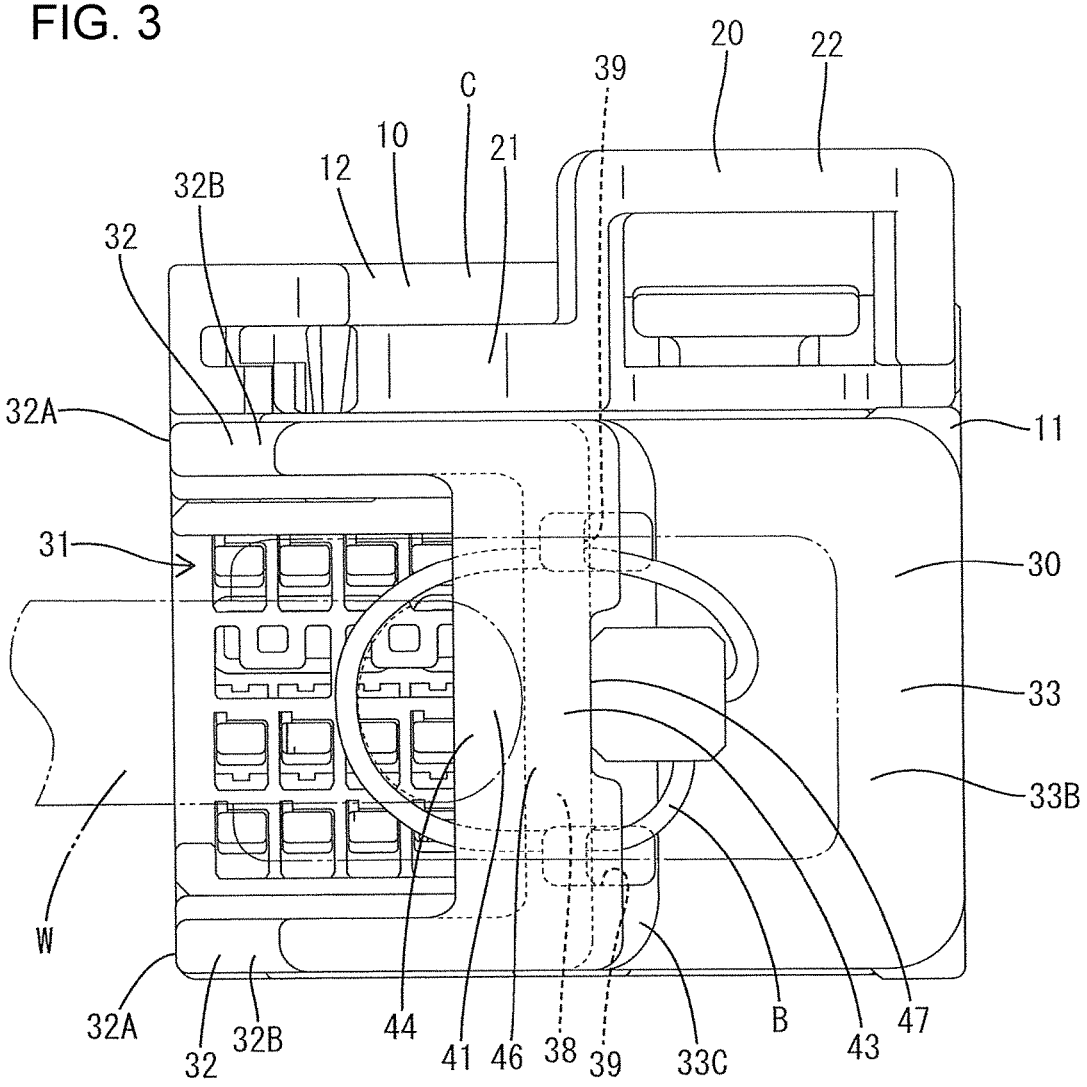
FIG. 3 is a back view showing the connector.

A recess 47 is formed in a lateral end part of the second protruding wall 43 (see FIG. 3). The recess 47 is provided in a vertical center of the protruding portion 41 and formed by cutting off a vertically long and narrow part from the end part of the protruding portion 41. Both end parts of the recess 47 in the vertical direction are inclined to be more open toward an end edge side of the protruding portion 41.

The protruding portion 41 includes a protruding piece 44 protruding from the second protruding wall 43 toward the open side of the wire cover 30. The protruding piece 44 is provided between the upper and lower first walls 32.

A part of the wire fixing portion 38 located on a side in front of the protruding portion 41 serves as a winding portion 45 on which the tie band B is wound as shown in FIG. 4.

The rear surface of the protruding portion 41 serves as a pressing surface 46 substantially perpendicular to the connecting direction. The pressing surface 46 is constituted by the rear surfaces of the protruding portion 41, the protruding piece 44 and the upper and lower first walls 32. The pressing surface 46 is an entirely flat surface. When viewed from behind, the pressing surface 46 has a rectangular shape long in the vertical direction and both upper and lower end parts project toward the open side of the wire cover 30, as shown in FIG. 3. Specifically, the rear surfaces of the second protruding wall 43 and the protruding piece 44 constitute one rectangular part long in the vertical direction, and the rear surfaces of the upper and lower first walls 32 constitute parts projecting from the upper and lower ends of this rectangular part.

Next, an example of an operation of fixing the wires W to the wire fixing portion 38 is described.

After the wire cover 30 is mounted on the connector body C, a bundle of the wires W is laid along the wire fixing portion 38 and the tie band B is wound on the wire fixing portion 38. At this time, the tie band B is passed through the band through holes 39 if the bundle of the wires W has a small diameter, and the tie band B is wound on the outer periphery of the wire fixing portion 38 without being passed through the band through holes 39 if this bundle has a large diameter.

In the case of tightening the tie band B without passing the tie band B through the band through holes 39, the tie band B moves toward the protruding portion 41 and comes into contact with the first and second protruding walls 42, 43 as being tightened. Further, as the tie band B is tightened, a head part of the tie band B is guided into the recess 47 to be circumferentially positioned. In this way, the tie band B is caught by the protruding portion 41 to be retained and the wires W are fixed to the wire fixing portion 38.

Next, an example of a connecting operation to the mating connector 50 is described.

First, the lever 20 is held at the initial position and the connector body C is pushed into the receptacle 52 of the mating connector 50 by pressing the pressing surface 46 of the wire cover 30. Then, the connector body C moves straight forward into the receptacle 52 by having a widthwise central part pressed, and the cam pin 53 of the mating connector 50 is inserted into the entrance 23A of the cam groove 23. Further, a locked state between the initial lock piece 24 and the initial lock 15 is released by the unlocking portion of the mating connector 50 to enable the rotation of the lever 20.

Subsequently, the lever 20 is rotated. When the lever 20 is rotated in a connecting direction by pressing the operating portion 22 of the lever 20, the connector is pulled toward the mating connector 50 by a cam action by the engagement of the cam pin 53 and the cam groove 23 and the connection proceeds.

When the connector reaches a proper connection position with respect to the receptacle 52, the terminal fittings and mating terminal fittings are connected electrically, thereby completing the connecting operation to the mating connector 50.

Next, functions and effects of the embodiment configured as described above are described.

The wire cover 30 of this embodiment is mounted on the rear surface of the connector body C connected to the ends of the wires W and holds the wires W while bending the wires W in the predetermined direction, and the wire fixing portion 38 is provided on a rear part to project in the predetermined direction provided and provided with the protruding portion 41 protruding in the direction substantially perpendicular to the connecting direction of the connector body C and the mating connector 50.

According to this configuration, since the rear surface (pressing surface 46) of the protruding portion 41 can be pressed at the time of the connecting operation to the mating connector 50, the connecting operation to the mating connector 50 can be performed easily.

The tie band B is wound on the side of the wire fixing portion 38 in front of the protruding portion 41 to fix the wires W. According to this configuration, the tie band B can be positioned by the protruding portion 41.

The recess 47 is formed in the protruding end part of the protruding portion 41. According to this configuration, the position of the head of the tie band B can be determined by fitting the head part into the recess 47 formed in the protruding portion 41. Further, the formation of sink marks can be prevented by forming the recess 47 in the protruding portion 41.

The connector of this embodiment includes the connector body C to be connected to the ends of the wires W, and the connector body C includes the housing 10 connectable to the mating connector 50 and the lever 20 enabling the mating connector 50 and the housing 10 to be connected properly by being rotated from the initial position to the connection position. The entrance 23A of the cam groove 23 engaged with the cam pin 53 provided on the mating connector 50 when the lever 20 is disposed at the initial position and the protruding portion 41 are located substantially at the same position in the width direction of the housing 10.

According to this configuration, by pressing the rear surface (pressing surface 46) of the protruding portion 41 at the time of the connecting operation to the mating connector 50, the connector body C can be pressed straight in a facing direction of the entrance 23A of the cam groove 23 of the lever 20 and the cam pin 53 of the mating connector 50.

The invention is not limited to the above described and illustrated embodiment. For example, the following embodiments are also included in the scope of the invention.

Although the protruding portion 41 protrudes in the lateral direction in the above embodiment, there is no limitation to this and, for example, a protruding portion may protrude in the vertical direction.

Although the protruding portion 41 is provided on the rear end part of the wire fixing portion 38 in the above embodiment, there is no limitation to this and, for example, a protruding portion may be provided at an intermediate position of a wire fixing portion.

Although the tie band B is positioned by the protruding portion 41 in the above embodiment, there is no limitation to this and, for example, a rib or the like for positioning a tie band may be provided at a position spaced forwardly from a protruding portion.

Although the protruding portion 41 protrudes toward both left and right sides from the wire fixing portion 38 in the above embodiment, there is no limitation to this and, for example, a protruding portion may protrude toward only one of left and right sides from a wire fixing portion.

Although the wire cover 30 can be mounted on the connector body C with the orientation changed in the lateral direction in the above embodiment, there is no limitation to this and, for example, the present invention can be applied also to wire covers which can be mounted only in one of leftward and rightward directions.

Although the connector body C includes the housing 10 and the lever 20 in the above embodiment, there is no limitation to this and, for example, the present invention can be applied also to connector bodies including no lever.

LIST OF REFERENCE SIGNS

B . . . tie band (band)
C . . . connector body
W . . . wire
10 . . . housing
20 . . . lever
23 . . . cam groove
23A . . . entrance of cam groove
30 . . . wire cover
38 . . . wire fixing portion
41 . . . protruding portion
47 . . . recess
50 . . . mating connector
53 . . . cam pin

The invention claimed is:

1. A lever-type connector with a wire cover, comprising:

a housing having opposite front and rear ends, the front end being connectable to a mating connector along a connecting direction, the rear end being configured to accommodate at least one wire extending from the housing;

a lever mounted on the housing for rotation from an initial position to a connection position about an axis that is perpendicular to the connecting direction, the lever having a cam groove with an entrance facing toward the front end of the housing when the lever is at the initial position and being dimensioned to receive a cam pin on the mating connector, the cam pin moving in the cam groove as the lever is rotated to the connection position for connecting the connector and the mating connector; and a wire cover having opposed first walls with front ends mounted to the rear end of the housing, side edges sloped toward one another at positions rearward of the housing and rear ends that are narrower than the front ends in directions perpendicular to the connecting direction, a protruding wall extending perpendicularly between the rear ends of first walls and protruding in the directions perpendicular to the connecting direction beyond the side edges of the first walls at the rear ends of the first walls to define a wire fixing portion around the first walls and forward of the protruding wall, and the entrance to the cam groove being aligned in the connecting direction with at least part of the protruding wall when the lever is at the initial position.

2. The lever-type connector with a wire cover of claim 1, further comprising a band around the wire fixing portion in front of the protruding wall of the wire cover to fix the wire.

3. The lever-type connector with a wire cover of claim 2, wherein a recess is formed in a protruding end part of the protruding wall, the recess accommodating at least a part of the band wound around the wire fixing portion.

4. The lever-type connector with a wire cover of claim 1, wherein the wire cover further comprises a second wall having a front end connected to the rear and of the housing, the second wall extending between the opposed first walls of the wire cover.

5. The lever-type connector with a wire cover of claim 4, were in a side of the wire cover opposite the second wall is open and is configured for accommodating the at least one wire extending from the rear end of the housing.

6. The lever-type connector with a wire cover of claim 4 wherein the second wall has apertures extending therethrough for accommodating a band for fixing the at least one wire to the wire fixing portion of the wire cover.

7. The lever-type connector with a wire cover of claim 1, wherein the protruding wall has a rear surface aligned substantially perpendicular to the connecting direction and substantially parallel to the axis about which the lever is rotatable.

8. The lever-type connector with a wire cover of claim 1, wherein the first and second walls of the wire cover are substantially perpendicular to the axis about which the lever is rotatable.

* * * * *